United States Patent [19]

Sanchez

[11] 4,384,464

[45] May 24, 1983

[54] APPARATUS FOR BENDING CUTS FOR MANUFACTURING GOODS OF LEATHER OR SYNTHETICAL MATERIALS

[76] Inventor: Ignacio O. Sanchez, Mariano Otero 127, Cojumatlán, Michoacán, Mexico

[21] Appl. No.: 159,687

[22] Filed: Jun. 16, 1980

[30] Foreign Application Priority Data

Nov. 14, 1979 [MX] Mexico ..... 180043

[51] Int. Cl.[3] ..... C14B 11/00; C14B 1/30; A43D 65/00

[52] U.S. Cl. ..... 69/7.7; 69/48; 12/64

[58] Field of Search ..... 69/2, 3, 7.7, 8, 17, 69/48; 12/1 R, 1 F, 1 W, 1 M, 54.4, 55, 57, 64

[56] References Cited

U.S. PATENT DOCUMENTS

| | | | |
|---|---|---|---|
| 1,181,758 | 5/1916 | Glass et al. | 69/7.7 |
| 2,468,616 | 4/1949 | Coppola | 69/8 |
| 3,160,899 | 12/1964 | Bile et al. | 12/1 F |
| 3,938,210 | 2/1976 | Mitchell et al. | 12/1 W |
| 4,194,376 | 3/1980 | Valks et al. | 69/48 |

*Primary Examiner*—Patrick D. Lawson

*Attorney, Agent, or Firm*—McAulay, Fields, Fisher, Goldstein & Nissen

[57] ABSTRACT

An apparatus for bending cuts of leather or other synthetic materials by means of a suction action exerted over the cuts, which were previously gummed, providing an additional action of pressure over the cuts manually or by a pneumatic press installed over the cover of the working bench.

7 Claims, 3 Drawing Figures

APPARATUS FOR BENDING CUTS FOR MANUFACTURING GOODS OF LEATHER OR SYNTHETICAL MATERIALS

BACKGROUND OF THE INVENTION

The present invention relates to an apparatus and process for bending cuts of leather or other synthetic materials for the manufacture of shoes, purses, belts, etc., wherein it is required to bend a small portion of the outline of the cuts prior to the manufacture of the goods.

Heretofore, it has been a problem to make the bending of cuts of leather or any other material, since a great ability and a long period of learning are required to attain a continuous hem adjusting to the mold, which action has been intended to be mechanized by means of the use of automatic or semi-automatic machinery, which is still a very common practice to effect this stage of the manufacturing of the goods of leather or synthetical materials in a manual form, with the consequent problems such practice involves, such as the time consumed in the manufacturing, the flaws of the hem, the ability required by the operator, etc., all of which contributes to a low production rate and a rise in costs of the goods.

SUMMARY OF THE INVENTION

Thus, it is a main object of the invention to provide an apparatus of simple construction but effective in its performance to bend cuts of leather or any synthetic material for the manufacturing of several goods, such as shoes, purses, belts, etc.

It is another object of the invention to provide a low cost apparatus which is easier to operate, with which the stage of bending cuts of leather or any other material can be performed, requiring from the operator only a short period of learning or training for acquiring the ability needed for the activity.

It is a further object of the invention to provide a procedure for bending cuts of leather or any other material, by means of which a perfect hem of the cuts can be obtained at a high rate of production and low cost.

The invention is related to an apparatus and process for bending cuts of leather or other synthetic materials wherein the apparatus essentially consists of a working bench with a cover, which presents a delimiting area in the form of a screen; an extractor with a suction field delimited to a specific area of the screen by means of a pattern provided with one or more cut-outs, wherein the cut-outs have a configuration in accordance with the form of the pieces which will be bent.

The process comprises the stages of: placing the cuts, which were previously gummed in their sections to be bent, into the cut-outs of the pattern; applying a suction action over the cuts and exerting an auxiliary pressure on the areas of the cuts where they are to be bent manually or by a pneumatic press.

These and other objects resulting from the description that follows will be widely covered, being understood that the description will be developed regarding a specific embodiment of the invention, and therefore it should not be deemed as limitative but rather exemplary of the invention, since it is intended that all modifications that can occur to those skilled in the art remain within the scope thereof, provided they do not depart from the spirit and scope of the invention.

DESCRIPTION OF THE PREFERRED EMBODIMENTS

Figure 1:
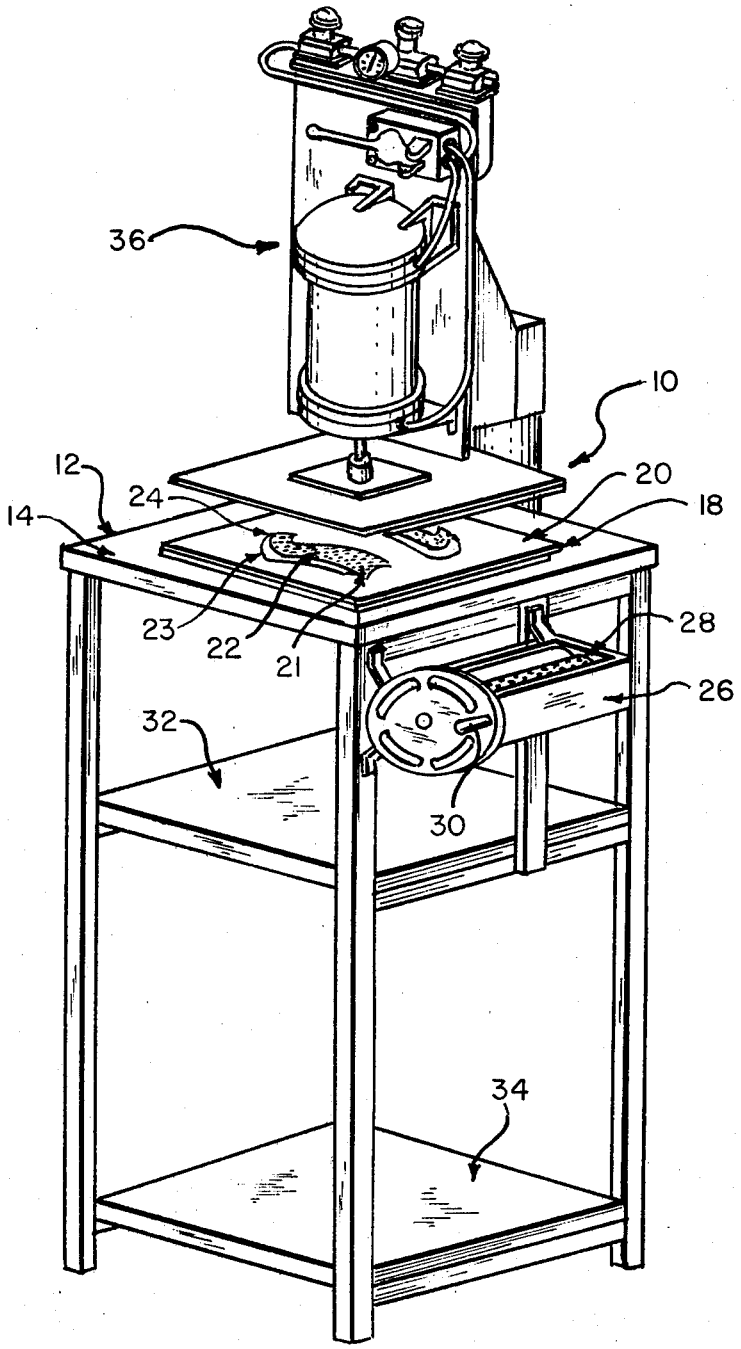
FIG. 1 is an isometric perspective view of the apparatus of the invention for bending cuts of leather or various materials.
Figure 2:
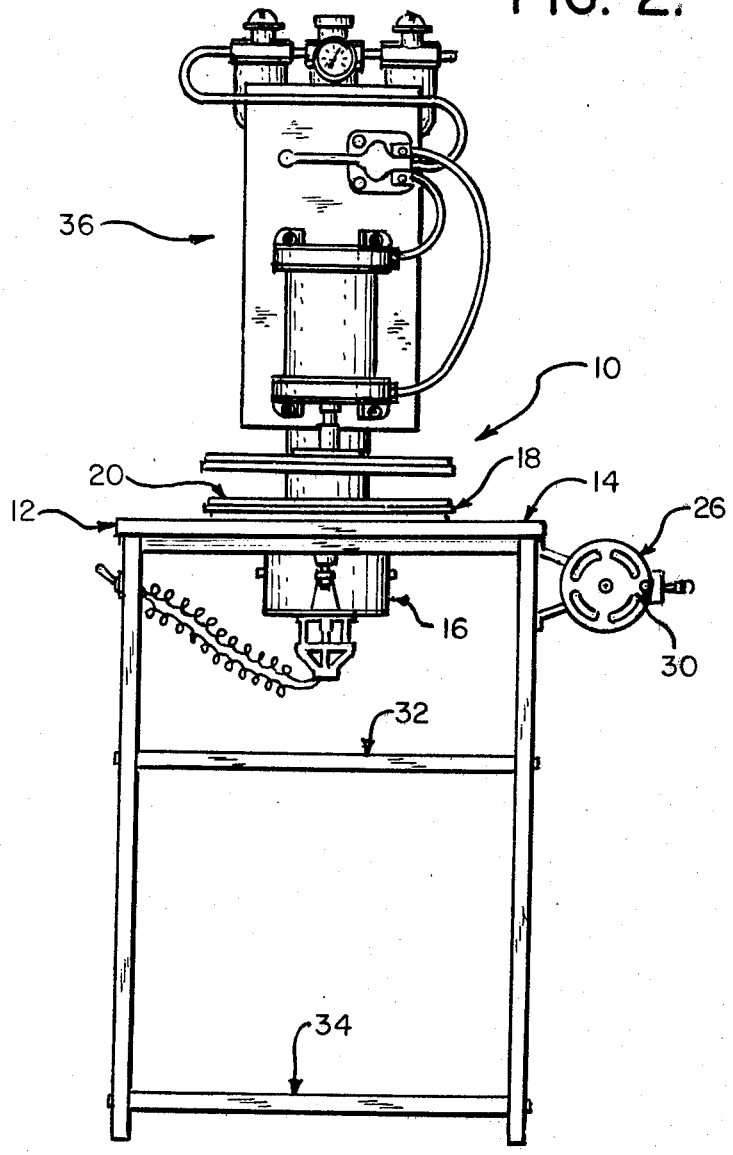
FIG. 2 is a front view of the apparatus of the invention.

From the annexed drawings, it can be appreciated that the apparatus according to the invention, which has been identified with general reference numeral 10, consists mainly of a working bench 12 provided with a cover 14 and of such a height that the operator can perform his duties in a comfortable position.

The working bench is also provided with several shelves 32 and 34 in order to have available areas for placing all of the tools needed for a good development of the function or process under consideration, with equipment such as adhesive, cuts, molds, punch, chisel, etc., said apparatus thus being a versatile type of equipment.

On cover 14 of the working bench 12, there is disposed a delimited area 18 constituted by a screen 22 provided with small drills on all its surface. The screen 22 is made of a material strong enough to withstand a high pressure, the purpose of which will be understood from the following description of the apparatus.

In the lower portion of screen 22 is disposed an air extractor 16, suitably mounted on the lower portion of cover 14 to guarantee that the suction exerted by said extractor is effected on all the area of screen 22.

On top of screen 22, and covering all the surface thereof, is provided a pattern or matrix 20 of a relatively flexible or deformable material, wherein cut-outs 24 have been previously effected, in such a shape to adapt to the cut to be bent, the cut-outs being of a slightly lower area than the cuts in the portion to be bent.

Figure 3:
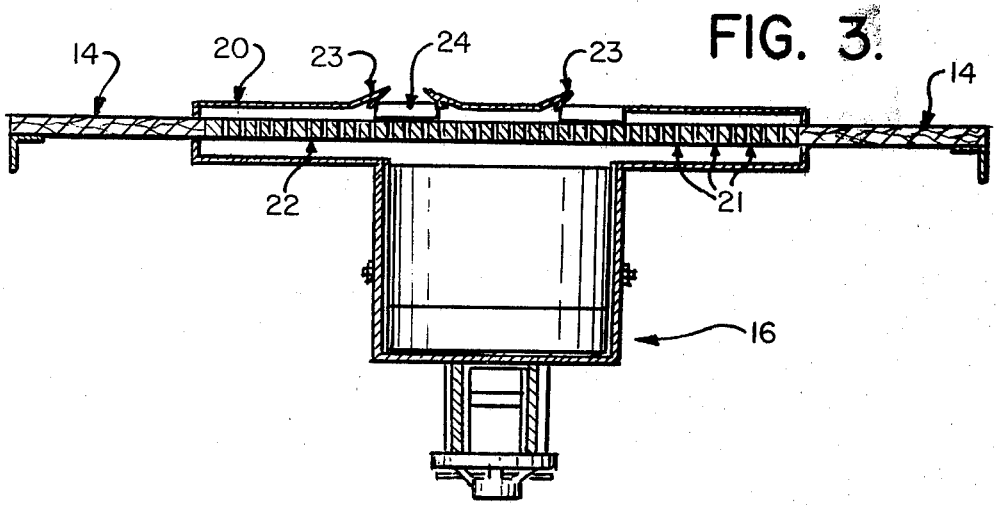
FIG. 3 is a cut-away view of the cover of the apparatus, as shown in FIG. 1 along line a—a.

From FIG. 3 it can be noticed that cut-outs 24 are provided with a section in their outline, such as reinforcements 23, made of a deformable material, and with their part facing to the inside of the cut-outs 24 projecting beyond the delimiting periphery of said cut-outs.

The apparatus according to the invention also has, in one of its embodiments, a manually operated roller press 26, the purpose of which will be hereinafter explained, or in some other cases a pneumatic, hydraulic or similar press, suitably mounted on cover 14 of the apparatus, designated in the drawings with reference numeral 36.

In order to achieve the bending of the cut, as was mentioned previously, the corresponding pattern 20 is placed on screen 22, the pattern containing the cut-outs corresponding to the configuration and size of the cut on which the hem is to be made; once the foregoing is made, and having put adhesive on the corresponding outline of the cuts, these are placed on the cut-outs 24, which adjust to the screen 22 due to the suction exerted by the extractor 16. Due to the configuration of the reinforcements 23, the cut tends to fold on itself, achieving the proper placement thereof by means of a punch, not shown, handled by the operator, which will exert pressure on the projecting portion of reinforcements 23 by means of a roller chisel also not shown, thereby exerting further pressure on the cuts in the section thereof intended to bend, thus obtaining a practically perfect hem of the cuts. The pressing stage manually effected can logically be effected with success by means of press 36.

Thereafter the cuts are withdrawn, and in the case that any flaw remains in the hem, this is manually remedied, then proceeding to effect the last stage of the process, which consists of clinching the adhesion of the hem by means of the introduction of the cuts on the press 26, which is provided with rollers 28, manually handled by means of handle 30, or by means of a motor that can be adapted thereto, thus obtaining a bent cut of flawless finish, not needing the use of a highly-trained operator and in a short period of time, due to the fastness of the system or the possibility of use of patterns with multiple cut-outs, as much as the available area of the pattern allows.

Typically, an operator would perform the process in the following way, once the cuts to be bent are prepared, as was mentioned previously, in the following steps:

1. The cut-outs receive the cuts to be bent, which cuts are placed on the matrix;
2. The motor is turned on by means of the switch to which it is connected, sucking the pieces to be bent against the cut-outs made on the pattern;
3. The pieces are properly placed that there are no air leakages and the material to be bent can be disposed on the matrix with high efficiency, with the aid of a punch to remedy the flaws of suction of the extractor;
4. A manual pressure is applied by means of a roller chisel, pressing against the protuberances of the pattern, which in turn presses the outline of the cut, thus achieving the bending;
5. The motor is turned off, the pieces are withdrawn, the flaws are remedied manually, and the pieces are passed through the press for affirming the quality of the work. It is to be noted that step 4 can be made mechanically or manually, by means of a rotary plate placed on the upper part of the apparatus and pneumatically, hydraulically or mechanically, commanded by a valve and a pressure gauge, for controlling the pressure instead of doing so with a chisel and a roller press.

It is to be understood that although the invention has been shown by means of the use of a determined pattern, it is clear that the pattern can contain more than two cut-outs, of different shapes, in order to adjust to the cuts to be bent.

What is claimed is:

1. An apparatus for bending cuts for manufacturing goods of leather or synthetic materials, comprising:

a working bench provided in an upper part thereof with a cover, said bench including a screen defining a delimiting area through which a suction action is exerted to conform the cuts to a desired configuration in accordance with a form of cut-outs provided in a pattern placed onto said screen, the form having one or various cut-outs corresponding to the configuration and similar to the cuts to be bent, said pattern being made of a deformable material that permits said pattern to adjust to said screen with the exception of those cut-out areas of the pattern on which said cuts are placed and which in turn are suctioned thus adjusting themselves to the configuration of said cut-outs thereby beginning to bend said cuts by action of the periphery of said cut-outs;

an extractor with a suction field delimited to the area of said screen for exerting its suction action mainly in the cuts placed on the cut-outs of said pattern; and a press for automatic operation, that exerts pressure against the bending of the cuts while these still remain on the cut-outs of the patterns to obtain the bending of said cuts.

2. The apparatus according to claim 1, wherein said screen is provided in substantially all its area with small drills through which the suction action is exerted on the cut-outs and on the cuts to be bent, said screen being sufficiently strong to withstand a high pressure such that the extractor in combination with the pressure exerted thereupon by said press does not alter the screen.

3. The apparatus according to claim 1, wherein said cut-outs of the pattern are provided, in a portion of their periphery with deformable protuberances which project toward said cut-outs, and said cuts are placed on said cut-outs, thus partially forming said bending which is finished with a press action by said press.

4. The apparatus according to claim 1, wherein said press is a manually operated roller press.

5. The apparatus according to claim 1, wherein said press is an automatically operated press.

6. The apparatus according to claim 1, wherein said extractor is mounted in fixed form to a lower part of said cover, for exerting sufficient suction for the fixation of the cuts disposed on said pattern cut-outs as well as for bending of said cuts in the corresponding section of the periphery thereof.

7. The apparatus according to claim 6, wherein said pattern cut-outs are provided with protuberances made of a deformable material, which project toward the insides of said cut-outs.

* * * * *